United States Patent [19]

Dwivedi et al.

[11] 4,199,373

[45] Apr. 22, 1980

[54] PROCESS FOR THE MANUFACTURE OF CRYSTALLINE FRUCTOSE

[75] Inventors: Basant K. Dwivedi, Randolph; Subodh K. Raniwala, Hoboken, both of N.J.

[73] Assignee: Chimicasa GmbH, Chur, Switzerland

[21] Appl. No.: 29,699

[22] Filed: Apr. 13, 1979

[51] Int. Cl.[2] ..... C13K 11/00; C13K 1/00; C13F 5/00

[52] U.S. Cl. ..... 127/60; 127/30; 127/61

[58] Field of Search ..... 127/30, 60, 61

[56] References Cited

U.S. PATENT DOCUMENTS

| | | | |
|---|---|---|---|
| 3,513,023 | 5/1970 | Kusch | 127/30 X |
| 3,684,573 | 8/1972 | Voigt | 127/30 |
| 3,718,484 | 2/1973 | Glabe | 127/30 |
| 3,756,855 | 9/1973 | Duchateau | 127/30 X |
| 3,816,175 | 6/1974 | Melaja | 127/30 X |
| 3,875,140 | 4/1975 | Barker | 127/30 X |
| 3,883,365 | 5/1975 | Forsberg | 127/30 X |
| 3,928,062 | 12/1975 | Yamauchi | 127/30 X |
| 3,929,503 | 12/1975 | Yamauchi | 127/30 X |

*Primary Examiner*—Sidney Marantz
*Attorney, Agent, or Firm*—Richard P. Crowley

[57] ABSTRACT

A process for the manufacture of free-flowing crystalline fructose, which process comprises seeding an 88% to 96% by weight fructose syrup with 2% to 15% by weight of fructose seed crystals at 120° F. to 160° F., the seed crystals having a size not greater than 250 microns, and permitting crystallization to occur at about 50° F. to 90° F. and at a relative humidity of less than 70%.

17 Claims, No Drawings

PROCESS FOR THE MANUFACTURE OF CRYSTALLINE FRUCTOSE

BACKGROUND OF THE INVENTION

Crystalline fructose is commercially manufactured by a very involved and time-consuming crystallization process which requires relatively sophisticated processing machinery and apparatus and careful control of process conditions, to ensure the production of a satisfactory crystalline-fructose product. As is well known, anhydrous fructose crystals may be obtained by crystallization of the fructose from both aqueous solutions and aqueous alcohol solutions, such as aqueous methanol and aqueous ethanol solutions of fructose. The employment of solvents in fructose solutions is undesirable, both from the economic point of view and since the resulting crystals precipitated from the solution and the liquid containing the solvent must have the solvent completely removed prior to consumption or use of the crystalline fructose, while economic operations also dictate the removal of the solvent from the mother liquid for use in the process.

A number of processes have been proposed in connection with the production of crystalline fructose from aqueous solutions. However, none of said processes has been satisfactory wholly, since they involve a number and a variety of process steps and careful control of various process-operating conditions and typically result in only very low yields of crystalline fructose.

For example, as disclosed in U.S. Pat. No. 3,513,023, crystalline fructose is produced through the employment of a fructose solution having at least 95% by weight fructose concentration, which is further concentrated in a vacuum to a water content of from about 2% to 5% and then cooled to a temperature of from about 60° F. to 80° F. A large quantity of the crystals are then added to the concentrated, cooled solution, and the mixture then must be stirred at a low temperature until it becomes a soft mass. This mass then is made solid and is dried at a temperature below about 150° F. The proposed process is not satisfactory where it is essential to the process that the fructose concentration be not less than 95%, that kneading of the soft mass occur and further that only pure crystalline fructose seed crystals be employed. The proposed method thus has disadvantages both in terms of material handling and high-energy costs, as well as being limited to the employment of pure fructose syrups.

Another fructose process is described in U.S. Pat. No. 3,883,365, which is directed to the process of the production of crystalline fructose from an aqueous solution, and which process involves providing a saturated fructose solution, adjusting the pH of the saturated solution within a pH of 4.5 to 5.5, and then seeding the solution with fructose crystals, and, thereafter, lowering the temperature of the solution and optimally evaporating the solution to cause the formation of crystalline fructose. The resulting crystalline fructose is then separated by centrifuge methods. This process requires a very careful controlled-temperature cooling of the over 90% fructose solution to generate crystals and to increase the crystal size. Seed crystals must be pure fructose crystals of low crystalline size, and the yield produced is typically less than about 50%. Periodically, the process must be stopped and the solution, from which crystallization is being carried out, diluted with additional water, to avoid supersaturation levels of the solution. The essence of the invention involves a criticality of the pH and the need to adjust the pH to the range of 4.5 to 5.5.

A further method for obtaining anhydrous fructose crystals is set forth in U.S. Pat. No. 3,928,062, which is somewhat similar to the process described in U.S. Pat. No. 3,883,365, wherein crystalline fructose is produced from a supersaturated fructose solution, seeding anhydrous crystals into the solution and then concentrating and/or coating the solution while maintaining the sugar concentration and the temperature in the liquid phase within a carefully defined range, and then recovering the anhydrous crystals from the mass. Once again, the yield is typically under 60%, while the disadvantages of the process also require precise control of process variables, such as the rate of cooling and the rate of evaporating, and the syrup concentration is limited to less than 90% by weight, in order to avoid supersaturated solutions.

A further process is also described in U.S. Pat. No. 3,929,503, wherein a method is provided to obtain free-flowing anhydrous particles of glucose, fructose or mixtures thereof in such forms as powder, pellets, granules and the like, without subjecting the solution to a crystallization step. The process involves kneading of crystals or powder of anhydrous glucose, fructose or mixtures thereof; that is, a mother powder, with a syrup containing 40% to 90% of the same type of sugar as the mother powder, so that the resulting mixture forms wet particles having a moisture content of less than about 7%. The disadvantage of this particular process is that, even in the case of the most favorable concentration of 95%, it is recognized that it is very difficult to distribute uniformly the powder, due to the practical difficulties of admixture, such as, for example, the very high viscosity. Once again the yield is only about 54%, as the remaining material must be recycled as the mother powder, and both energy costs and material-handling costs are much higher, because of the poor yield.

Therefore, it would be most desirable to provide a process for the production of crystalline fructose, which process avoids the many disadvantages of the prior-art processes, and which process would present a simple and economical process avoiding the large capital and equipment costs and the careful process-control conditions associated with the prior-art processes.

SUMMARY OF THE INVENTION

Our invention relates to a process for the manufacture of free-flowing, anhydrous, crystalline fructose and mixtures of crystalline fructose and glucose. In particular, our invention concerns an improved, economical process for the preparation of a free-flowing, anhydrous, crystalline fructose from concentrated fructose, and high-fructose corn-syrup solutions.

Our process concerns the manufacture of free-flowing, anhydrous, crystalline fructose or high-fructose corn-syrup solids, which process comprises seeding 88% to 96% by weight of a syrup-containing aqueous solution with a seed of the same or of a major sugar, in the case of an impure mixture of the syrup solution, of a size not greater than about 250 microns and typically about 150 microns or less and in an amount of from about 2% or more; for example, 2% to 15% by weight, based on the total solids present in the syrup solution, and allowing crystallization to take place in a period of time of from about 2 to 72 hours, depending upon the type and size of the seed crystals employed, percent relative humidity and temperature and the moisture content of the high-fructose, corn-syrup solution used, and, thereafter, recovering the resulting crystalline material so produced and drying and size-reducing, such as by grinding, said crystalline material, to produce an anhydrous, free-flowing fructose or mixtures of fructose and glucose.

The process of our invention provides a simple and economical method of providing free-flowing, anhydrous particles of fructose cr mixtures of glucose and fructose, through a simple seeding and crystallization step, and avoids the difficulties associated with prior-art processes.

The aqueous fructose, and high-fructose corn-syrup composition employed in the process should comprise from 88% to 96% by weight of the fructose or fructose/glucose mixture, and typically from about 90% to 95% by weight, while the most preferred concentration ranges from about 92% to 94% by weight. The aqueous syrup composition should be brought to the desired solids content, and, in the event that any heating or cooking is required to so adjust the solids content, such heating or cooking should be carried out preferably under vacuum and at a temperature of not more than 200° F., in order to avoid any discoloration in the resulting syrup solution, which discoloration retards the crystallization. The syrup solution may comprise fructose, a mixture of fructose and glucose or, for example, a high-fructose corn-syrup solution.

It is essential, in the practice of the invention and process that, during crystallization, the relative humidity should be maintained below 70%; for example, preferably below 50% and most preferably between 35% to 45%, and the surrounding temperature should be maintained either between 50° F. to 90° F. or sequentially decreased to this range or lower. The seed size of the crystals should not be greater than 250 microns, and typically less than 200 microns, such as, for example, from about 50 to 150 microns. It has been discovered that a larger size of the seed crystals does not lead to crystallization of the material from the aqueous syrup solution in any reasonable time period, and, therefore, affects the commercial viability of the process. In addition, the amount of the seed crystals employed is a critical effect on the ease of drying of the final crystalline material produced in the process. It has been discovered further that the amount of seed crystalline and the moisture content of the syrup solution becomes significant in terms of crystallization time, when the seed crystals do not have the same contents or represent the same type of crystals as that employed in the syrup solution. It has been found that the amount of seed crystals employed should be greater than 2% by weight, based on the total solids present in the syrup solution, and more particularly should range from 5% to 15% by weight, which is the preferred amount employed.

The seed crystals employed in the process may be derived from any source, but typically should represent pure fructose crystals, a mixture of glucose and fructose crystals, or should represent a part of the finished crystalline product obtained in the process and recycled in a subsequent crystallization process. In any event, it is important to employ the seed crystals in the same general type, character and nature of that of the composition of the sugar in the aqueous syrup composition, since variations in the nature of the seed crystals from that of the syrup composition affect the crystallization time.

Typically the seed crystals should be added to the syrup composition, when the syrup composition is at a temperature ranging from about 120° F. to 160° F., and more particularly about 130° F. to 140° F. The syrup composition, after seeding, may be deposited in a mold or other suitable container and then allowed to sit at 50° F. to 80° F. and a relative humidity of 35% to 45% for a crystallization time from about 6 to 72 hours. Pure fructose syrups may take only a short period of time; for example, as low as 3 to 4 hours, while corn-syrup compositions; that is, containing a mixture of glucose and fructose, typically take a longer period of time, such as, for example, 36 to 72 hours. At the end of such crystallization time, the crystalline material is recovered and dried, with the method of drying depending upon the moisture content desired in the final product, and then ground to produce the free-flowing, anhydrous, crystalline fructose and glucose of the invention. If desired and preferably, a small percentage of the recovered material then may be recycled and used as a seed crystal with the same type of syrup composition.

In regards to the concentration range of the syrup composition, the syrup concentration is critical, since it has been discovered that, if the range is generally below about 88% by weight, the solution remains pasty, even after the addition of seed crystals, and any crystallization produced is in a paste-type form which is hard and impossible to bring into a dry, free-flowing, anhydrous, powder form. If the syrup composition exceeds generally about 96% by weight, the syrup composition remains as a rather glassy-type syrup mixture. During the crystallization time, the seeded syrup mixture is allowed to sit generally at temperatures of from about 60° F. to 85° F. such as, for example, 70° F. to 80° F. and a relative humidity of 35% to 45%, until substantial crystallization takes place, with the physical condition of the final crystalline product depending in part upon the moisture content of the starting syrup solution.

It has been found that the crystalline product produced by the process is formed in large pellets in the crystallization process; for example, about 3 grams in weight, and the crystallization pellets so formed are quite heat-sensitive. The crystallization pellets have been found not to lose moisture during drying after a certain moisture content is reached; for example, 3% to 5%. For example, hemispherical pellets, with a base diameter of about 0.75 inches, do not lose moisture beyond about 3%. Attempts to dry such pellets to a lower moisture content, by subjecting the pellets to higher drying temperatures and vacuum, have been unsuccessful, as the surface tends to dry, but the inside material of the pellets only softens.

It has been found that the heat-sensitive, water-soluble crystallization pellets of the process may be dried to a desired moisture content by cooling the pellets to a temperature below about 34° F. and then granulating the pellets, such as by grinding, to less than 18 mesh. Thereafter, the ground pellets may be dried in a low relative humidity; for example, less than 50%, such as 35% to 45%, at oven temperatures; for example, 110° F. to 160° F., to provide free powdered material with a low moisture content; for example, 0.5% to 2%. Thus the high heat sensitivity of the crystallization pellets makes the product difficult to grind, since the product tends to melt due to heat buildup in the grinding mill. However, the pellets, when cooled to 34° F. or below, may be ground, and, thereafter, may be dried in conventional ovens to a low moisture content.

For the purpose of illustration only, our process will be described in connection with certain preferred operating embodiments; however, it is recognized that various changes and modifications in the process, as described and illustrated, may be made by those persons skilled in the art, all within the spirit and scope of our invention.

DESCRIPTION OF THE EMBODIMENTS

EXAMPLE 1

The term "high-fructose corn syrup" used in this example is used for the following commercially available product:

| Dry Basis Composition | |
|---|---|
| Ash (Sulfated) | .03% |
| Carbohydrate components | |
| Fructose | 90% |
| Dextrose | 7% |
| Other saccharides | 3% |
| Typical analysis | |
| Solids | 80% |
| Moisture | 20% |

The syrup was cooked to a moisture content of 92±0.5% and seeded with 5% seed of a size of 177 to 250 microns. The product was placed in molds and allowed to sit at 78° F. and a relative humidity of 30%. The crystallization commenced in 24 hours. The resultant product was dried in a vacuum oven maintained at 29" of Hg. The temperature was gradually increased from 70° F. to 200° F. in 16 hours. The product was worked up to the required particle size. Free-flowing, nontacky, crystalline material was obtained.

Some cooked syrup was seeded with the product obtained above the crystallization time reduced to 8 hours.

EXAMPLE 2

Pure fructose was dissolved in water to obtain a syrup of 95% solids content. This was seeded with 5% crystalline fructose of a size of 74 to 177 microns, deposited in molds and was allowed to sit for 72 hours at 80° F. and a relative humidity of 45%, and then worked up and dried in the oven by gradually increasing the temperature from 70° F. to 200° F. in 4 hours. The product was free-flowing and nontacky.

EXAMPLE 3

Pure fructose was dissolved in water to obtain a syrup of 93% solids content. It was brought to a temperature of 140° F. and seeded with 10% crystalline fructose of a size of 74 to 174 microns. The resultant material was deposited in molds and allowed to crystallize at 85° F. and a relative humidity of 45%. After 12 hours, it was dried and ground. The product was free-flowing, nontacky and crystalline.

EXAMPLE 4

A 2-pound sample of the crystallization-pellet material of the process was cooled and ground in a domestic blender. The resulting powder was then screened through an 18-mesh screen. The undersized product was dried in a temperature-controlled oven in the presence of circulating air as follows, to provide a low moisture-free, flowing product:

| TIME | TEMPERATURE | MOISTURE CONTENT |
|---|---|---|
| 8 | 110 ° F. | 2% |
| 4 | 150 ° F. | 1% |

Attempts to dry the same pellet material, by conventional oven-drying of the pellets to low moisture content, were unsuccessful.

As can be seen by the aforesaid data and examples, the syrup concentration and the nature of the seed crystals and crystallization conditions and more specifically relative humidity are essential conditions, in order to produce and provide for the advantages of our process.

What we claim is:

1. A process for the manufacture of an anhydrous, free-flowing, crystalline, fructose-containing material, which process comprises:

(a) providing an aqueous fructose-containing composition having a weight of from about 88% to 96% by weight of fructose or a mixture of fructose and glucose, and which solution is essentially free from discoloration;

(b) seeding said fructose-containing solution with from about 2% to 15%, based on the total weight of the solution, with seed crystals of the same general composition as the composition of the solution, and having a particles size of not greater than about 250 microns and at a temperature of from about 120° F. to 160° F.;

(c) permitting such seeded syrup solution to stand at about 50° F. to 90° F. and at a relative humidity below 70%, to provide for substantial crystallization of the fructose and/or glucose in the solution; and, thereafter, (d) recovering the crystallized fructose from the crystallization solution and drying the fructose so recovered, to provide for a free-flowing, anhydrous, crystalline fructose or mixture of fructose and glucose.

2. The process of claim 1 wherein the seed crystals have a particle size of from about 50 to 200 microns.

3. The process of claim 1 wherein the concentration of the syrup solution ranges from about 90% to 95% by weight.

4. The process of claim 1 wherein the crystallization is carried out at a temperature of from about 50° F. to 120° F. and the temperature is decreased sequentially from seeding temperature to this range.

5. The process of claim 1 wherein the crystallization time ranges from about 12 to 72 hours.

6. The process of claim 1 wherein the amount of seed crystals employed ranges from about 5% to 15% by weight.

7. The process of claim 1 wherein the solution comprises a high-fructose corn-syrup solution.

8. The process of claim 1 wherein the solution comprises a sugar-fructose solution of from about 92% to 94% by weight fructose or a mixture of fructose and glucose.

9. The process of claim 1 wherein the relative humidity of the surrounding air during crystallization is maintained from about 35% to 45%.

10. The process of claim 1 wherein the seeded syrup solution is allowed to stand for a period of time ranging from about 6 to 72 hours at a temperature of from about 50° F. to 120° F. and the temperature is decreased sequentially and the relative humidity maintained below 50%.

11. The process of claim 1 which includes grinding the crystallized, recovered fructose at a temperature of below about 34° F., and, thereafter, drying the ground fructose to a moisture content of about 2% or less.

12. The process of claim 1 wherein the seed crystals are derived from a syrup solution of essentially the same composition and from a prior process.

13. A process for the manufacture of free-flowing, anhydrous, fructose-containing, crystalline particles, which process comprises:

(a) providing for a fructose- or fructose/glucose-containing syrup solution having a weight of from about 90% to 95% by weight of fructose or fructose and glucose, and which solution is essentially free from discoloration;

(b) seeding said syrup solution with from about 2% to 15% by weight of fructose seed crystals, wherein the crystals have a particle size ranging from about 50 to 200 microns, the seeding carried out at a temperature of from about 120° F. to 160° F., the seed crystals derived from the crystals obtained from the same syrup of the same process;

(c) allowing the seeded syrup solution to stand at a temperature of from about 60° F. to 85° F. and a relative humidity less than 70% for a period of time of from about 6 to 72 hours, to permit the crystallization of the fructose and glucose/fructose from the seeded syrup solution; or (d) recovering the crystalline fructose and fructose/glucose from the solution and drying the recovered fructose, to produce a free-flowing, anhydrous, crystalline fructose or glucose/fructose mixture.

14. The process of claim 13 which includes grinding the crystallized, recovered fructose or glucose/fructose at a temperature of below about 34° F., and, thereafter, drying and ground fructose or glucose/fructose to a moisture content of about 2% or less.

15. The process of claim 14 which includes drying the fructose or fructose/glucose at a relative humidity of less than 50% and at an oven temperature of from 110° to 160° F. to provide a free powdered material having a moisture content of 0.5 to 2% by weight.

16. The process of claim 14 which includes grinding the fructose or fructose/glucose to a mesh size of less than about 18 mesh.

17. The process of claim 13 which includes allowing the seeded syrup solution to stand for a period of 36 to 72 hours.

* * * * *

UNITED STATES PATENT OFFICE

CERTIFICATE OF CORRECTION

PATENT NO. :4,199,373

DATED :April 22, 1980

INVENTOR(S) :Basant K. Dwivedi et al

It is certified that error appears in the above-identified patent and that said Letters Patent are hereby corrected as shown below:

In column 7, line 27, claim 13(b), delete "of the same process" and insert --of a prior process--.

In Column 8, line 5, claim 13(c), delete "and" and insert --or--.

In column 8, line 6, claim 13(c), delete "or" and insert --and--.

In column 8, line 14, claim 14, delete "and" and insert --the--.

Signed and Sealed this

*First* Day of *July 1980*

[SEAL]

*Attest:*

SIDNEY A. DIAMOND

*Attesting Officer*

*Commissioner of Patents and Trademarks*